US005941660A

United States Patent [19]

Rueckert

[11] Patent Number: 5,941,660

[45] Date of Patent: Aug. 24, 1999

[54] MODULAR WATERCRAFT SUPPORT STRUCTURE

[76] Inventor: David Rueckert, 18860 Loxahatchee River Rd., Jupiter, Fla. 33458

[21] Appl. No.: 09/053,317

[22] Filed: Apr. 1, 1998

Related U.S. Application Data

[63] Continuation-in-part of application No. 08/808,003, Mar. 3, 1997, Pat. No. 5,795,098.

[51] Int. Cl.[6] ..... B63C 5/04

[52] U.S. Cl. ..... 405/7; 114/48; 114/263; 405/3

[58] Field of Search ..... 405/7, 3, 1; 114/44–48, 114/263, 230

[56] References Cited

U.S. PATENT DOCUMENTS

| | | | |
|---|---|---|---|
| 123,402 | 2/1872 | Janicki | 114/48 |
| 2,536,475 | 1/1951 | Thomas | 114/45 |
| 2,761,409 | 9/1956 | Harris | 114/48 X |
| 3,448,712 | 6/1969 | Lehmann et al. | 114/44 X |
| 4,732,102 | 3/1988 | Holmann et al. | 114/48 X |
| 4,735,164 | 4/1988 | Burg | 114/263 X |
| 5,281,055 | 1/1994 | Neitzke . | |
| 5,549,070 | 8/1996 | Cruchelow et al. | 114/263 |
| 5,551,366 | 9/1996 | Kavanaugh | 114/45 X |
| 5,590,978 | 1/1997 | Urbank | 405/3 |
| 5,641,242 | 6/1997 | Riviere | 405/3 |
| 5,682,833 | 11/1997 | Eva, III . | |

FOREIGN PATENT DOCUMENTS

| | | | |
|---|---|---|---|
| 0137096 | 6/1988 | Japan | 114/48 |

*Primary Examiner*—Dennis L. Taylor
*Attorney, Agent, or Firm*—McHale & Slavin, PA

[57] ABSTRACT

A watercraft support structure formed from a plurality of rigid platforms that are coupled together by the use of linking pins or insertion plugs. Each platform having independent buoyancy formed integral therein for support of most any size watercraft. The structure includes multiple ramp, cradle, and flat platforms, allowing an individual to customize a support structure for a particular sized watercraft. The platforms allow the structure to raise or fall with each tidal change. One embodiment of the dock assembly 110 includes a hinge-type connection that promotes ease of loading and unloading of a watercraft. The dock assembly 110 may also be configured to provide a surface to which watercraft may be moored.

22 Claims, 7 Drawing Sheets

MODULAR WATERCRAFT SUPPORT STRUCTURE

This is a continuation-in-part of application Ser. No. 08/808,003, filed Mar. 3, 1997 now U.S. Pat. No. 5,795,098.

FIELD OF THE INVENTION

This invention relates generally to the storage of watercraft and, more particularly, to a personal watercraft support structure that is modular in configuration and maintains the watercraft in close proximity to the water despite tidal changes or watercraft weight.

BACKGROUND OF THE INVENTION

Boating is a popular outdoor activity that is shared among friends and family members. The unpredictability of water lends a challenge to the boater and, depending on the size of the boat, typically requires at least two individuals to operate a boat safely. However, the introduction of personal watercraft has made operation by a single individual possible. This ability has made boating an affordable activity which may now be enjoyed by all individuals.

Personal watercraft includes jet-skis, wave runners, and similar water going vessels. Such watercraft can be easily maneuvered by a single individual. These watercraft are typically propelled by a water jet formed integral to the vessel. An individual need only operate simple controls to cause operation of the vessel to propel an individual to high speeds.

Although personal watercraft may be transported on a trailer, many individuals choose to leave such vessels in the water. However, unless properly conditioned, extended storage in the water can result in damage to the watercraft. For instance, the outer surfaces of a wave runner that is kept in a fresh water lake may become fouled with algae. This fouling will diminish vessel performance and detract from appearance of the watercraft. In addition, the algae may foul the propulsion jet. Additionally, if the vessel's engine is water cooled, algae buildup may foul the cooling system leading to premature engine failure. This fouling problem is even more troublesome if foreign matter such as mussel zebras attach to the operating components.

In addition, should a watercraft develop a leak in the hull, there is a possibility that the watercraft may sink if left unattended. Even visual inspection does not always reveal hull damage. For example, hydrolysis of the fiberglass can result in a hull breach that may result in a slow sinking of the vessel.

Leaving a watercraft in salt water can also be troublesome. Salt water, especially warm tropical water, can quickly cause vessel fouling. Barnacles will attach to the hull of a vessel and, in light of their hard shell, cause a most noticeable reduction in watercraft efficiency. Should the barnacles attach themselves to the cooling or jet intake, the result will be engine damage.

For these reasons, watercraft is raised out of the water to prevent the onslaught of problems, while keeping the vessel close to the water for ease of use. Large flotation platforms allow an individual to place a watercraft on top of the structure to inhibit contact with water. Some floating structures allow the watercraft to drive onto the support. However, if the structure is rigid, the watercraft may be damaged during the maneuver.

Another problem with floating structures of the prior art is that most such structures are fixed in length making them difficult to transfer or store. In the northern half of the United States, watercraft must be removed for the winter season due to the icing conditions. In these circumstances, the support structure must be removed. Due to structure size and associated weight, most structures are removed by several individuals. In addition, once the structure is removed, the size may cause difficulty in storing or transporting to another location.

Another problem with the prior art floating structures is the design parameters which require the structure to be sized to accommodate a type or size of watercraft. Watercraft may hold one, two, or more individuals. If the floating support structure is inappropriately sized or inadequate for a given vessel, a vessel owner may have to exchange the entire structure. In addition, should the vessel owner choose to purchase a larger watercraft, or a small boat, a fixed-sized support structure will not be adequate.

To accommodate the a variety of watercraft styles and shapes, several types of "temporary" modular docks have been developed. However, a typical problem that faces known modular docks is the difficulty of coupling the component sections during installation or disassembly. This problem is addressed by this embodiment.

In northern climates, where cold weather prevents boat use during a portion of a each year, docks must be removed from the water to avoid the crushing effects of ice. In southern climates, docks must also be removed periodically to combat algae or barnacle growth. As a result, individuals either assemble the component sections on shore or immerse their hands in water to perform the coupling necessary to form a docking structure.

U.S. Pat. No. 5,281,055 ('055) discloses one such coupling device that joins component sections to form a floating dock. This coupling device employs dog-boned shaped inserts that engage female sockets formed along the upper and lower surfaces of each component portion. The inserts are bolted together by an anchor rod threaded between the inserts, with each component section having a curvature to accept the anchor rod. Assembly of the '055 dock requires an individual to either turn the component sections on end or use a specialized tool to secure the components. Although the '055 dock may be assembled on the water, such assembly requires extreme care: the anchor rod is negatively buoyant and will sink if it is dropped or slips free before secured.

Other devices disclose cube-type floating docks such as that disclosed in U.S. Pat. No. 5,682,833, wherein the anchoring mechanisms are located in each corner. This provides the installer with the type of difficulties describe above. When a fourth cube is used to form a square, an individual must either install the anchoring mechanism out of the water or use a specialized tool join the components.

Thus, what is lacking in the art is a watercraft support structure that is lightweight in construction, modular in design, and allows for ease of assembly, disassembly, and storage. Additionally, there is a need for a modular watercraft support that will accommodate vessels of various lengths and may be increased in size to support small boats.

Watercraft of various types are referred to throughout this application. While specific examples of watercraft are given for illustrative purposes, it is to be understood that the present invention is suitable for all types of vessels which travel on water. These vessels include, but are not limited to small fishing boats, inflatable boats, kayaks, inflatable boats, rowing skulls, jet-propulsion boats, outboard and inboard/outboard boats, and seaplanes.

SUMMARY OF THE INVENTION

The instant invention is a floating storage device for personal watercraft. The instant invention addresses the above captioned problems and presents a watercraft support device having a linking system that allows multiple platforms to be joined, while allowing an assembler to remain dry. In one embodiment, the device employs a group of rigid platforms that are joined together by the use of linking arms and interlocking pins. The linking arms extend from each platform and are interlocked in such a manner so as to allow for flexibility in support, which assists in vessel loading. The linking pins pass through bores in the overlapped linking arms to secure the platforms in a contiguous linear series. The pins are removable and allow the structure to be modified to a particular structure length. The device is tethered to a dock by tethering posts that pass vertically through selected bores not otherwise occupied by linking pins.

In another embodiment, two or more platforms may be joined by use of insertion plugs inserted downward into securing cavities located within each platform. More specifically, the plugs are inserted into pairs of cooperating securing cavities, once the platforms are aligned as desired. The insertion plugs include retention tabs that engage a lower surface of the platforms, locking the platforms in place. The retention tabs flex inward as the insertion plugs are fed downward. The retention tabs spring outward once the lower portion of the insertion plug bottom surface clears the platform lower surface. The insertion plug is then cinched upward by attachment bolts threaded through a capping member placed above the insertion plug. As the attachment bolts are tightened, the insertion plug is drawn against the capping member. As a result, the retention tabs and capping member lock the insertion plug within the securing cavities. The securing cavities are approximately four inches in diameter and are useful for anchoring the platforms to an existing dock. Four-inch-diameter tethering pipes may be placed directly through the securement cavities and secured, via brackets, to an existing dock or seawall. With largerdiameter tethering posts, a post adaptor used. The post adaptor is secured into a post-facing end of the platforms and includes a post hole of appropriate size. For example, the post adaptor may accommodate a six-inch-diameter tethering post by including a post hole that permits passage of the tethering post.

Each platform within the device is shaped according to its intended use. A flat platform is designed to allow walking and standing by individuals, a cradling platform is designed to support the hull of a watercraft, and a ramp section is shaped to support a portion of the hull of a watercraft and to allow entry of the watercraft onto the device. Additionally, each platform is filled with foam to increase the rigidity and buoyancy of each platform.

The modular shape allows a combination of any platform thereby permitting the structure to be expanded by simply adding additional platforms. In this manner the structure may support a single person wave runner or be expanded to accommodate a 40 foot lightweight boat such as the Scraabb.

The platforms are formed from a mixture of polyethylene and an emulsifier that is placed in a rotating mold. The heating of the mixture results in a hard shell with seceding layers of density through the platform. The result is a rigid platform that cannot sink despite breaching in the structure or withhold water within the structure.

Accordingly, it is an object of the present invention to provide a watercraft support structure which lifts a watercraft hull above the waterline.

Still another object of the present invention is to provide a watercraft support structure which is modular in design to allow several platforms to be linked together.

A further object of the present invention is to provide a watercraft support structure having sloped, overlapping pieces that allow hinge-type pivoting of adjacent platforms.

Yet still a further object of the present invention is to provide a watercraft support structure which is a shell filled with a buoyant material that bonds with the inside walls of the shell to give structural support to the shell, while providing device buoyancy.

Still yet another object of the present invention is to provide a watercraft support device which provides dynamic support of a vessel during loading and unloading.

An additional object of the instant invention is to disclose an anchoring device for floating docks that can be installed from above the water line on a single side surface of the docks.

Yet another object of the instant invention is to disclose a modular docking system that allows for a infinite array of dock layouts with secure coupling of the docks through the use of the top mounted anchoring system.

Still another object of the instant invention is to disclose docks having dual purpose alignment holes receptive to four-inch-diameter securement pipes.

Yet still another objective of the instant invention is to disclose a multi-purpose anchoring device that allows coupling of cleats, railings and the like dock attachments.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
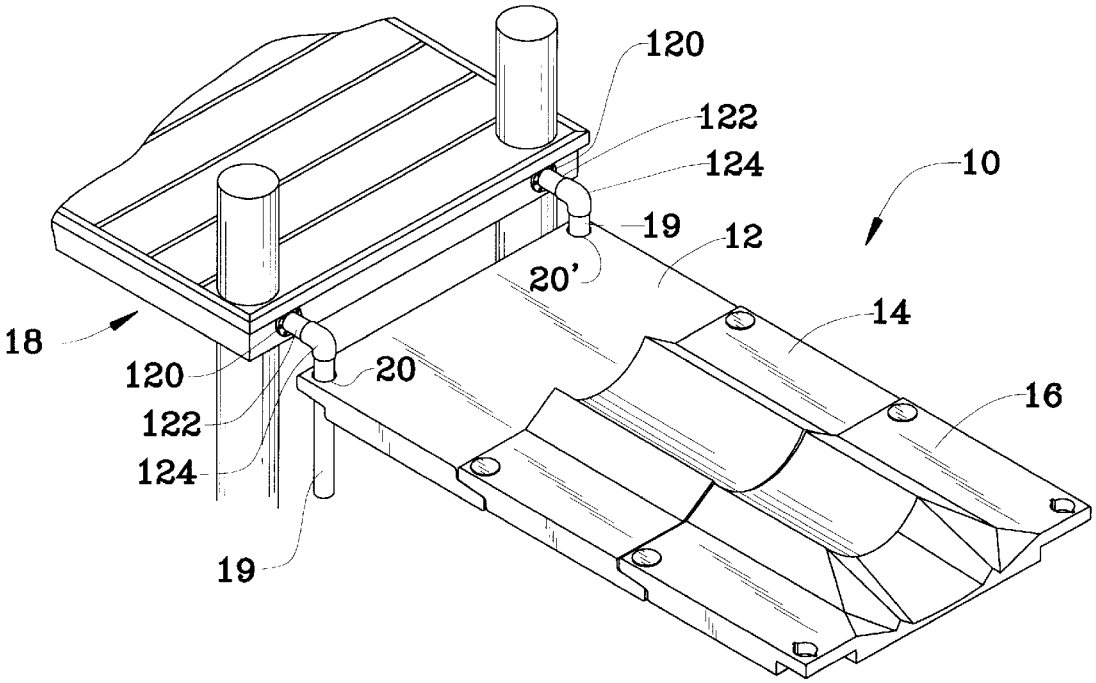
FIG. 1 is a pictorial view showing the present invention secured to a dock.

Reference is made in general to the Figures, wherein one embodiment of a watercraft support device 10 is shown, and depicted specifically in FIG. 1. The device 10 comprises a flat platform 12, a cradling platform 14, and a ramp platform 16. The platforms Aeneid 16 are linked together and provide a floating surface on which a watercraft may be parked. As will be described below, the device 10 is attached to a dock 18 via tethering posts 19 which are permanently secured to the dock 18 and which pass through vertical bores 20,20' in the device.

Figure 2:
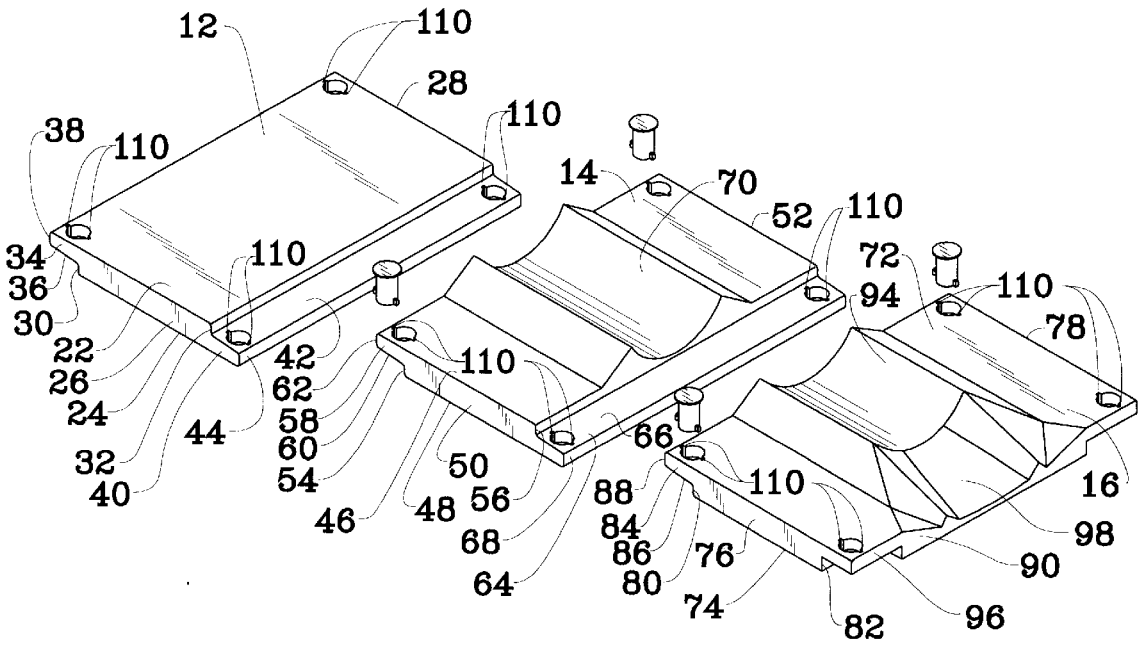
FIG. 2 is a spaced-apart, perspective view of the present invention.
Figure 3:
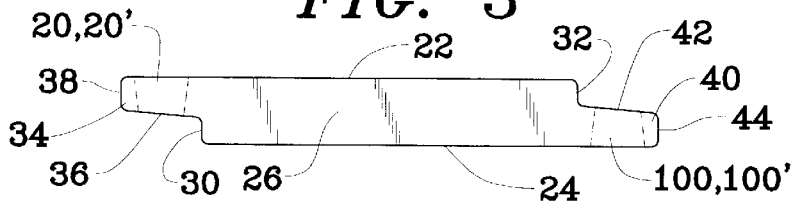
FIG. 3 is a side elevation view of a flat platform of the present invention.
Figure 4:
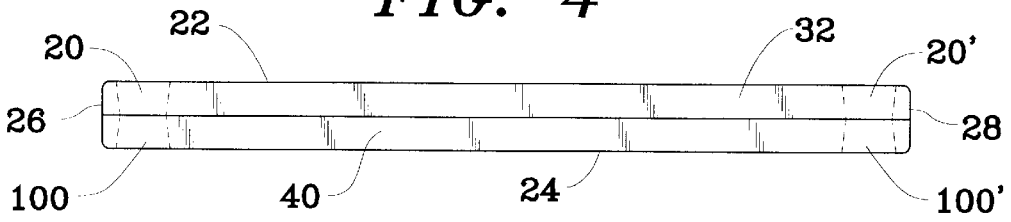
FIG. 4 is a back elevation view of a flat platform of the present invention.

Now referring generally to FIGS. 2–4, the flat platform 12 is a substantially-rectangular, rigid structure having a horizontal upper surface 22 spaced apart from a horizontal lower surface 24 by a first vertical sidewall 26, a second vertical sidewall 28, a vertical front wall 30, and a vertical back wall 32. An integral frontal linking arm 34 extends from the front wall 30. The frontal linking arm 34 is bounded by the upper surface 22, first sidewall 26, and second sidewall 28 of the flat platform 12. The frontal linking arm 34 has an inclined bottom surface 36. As such, the distance between the upper surface 22 and the bottom surface 36 decreases from a maximum near the flat platform front wall 30 to a minimum at a distal end 38 of the linking arm 34. An integral rearward linking arm 40 extends from the back wall 32. The rearward linking arm 40 is bounded by the lower surface 24, first sidewall 26, and second sidewall 28 of the flat platform 12. The rearward linking arm 40 has an inclined top surface 42. As such, the distance between the lower surface 24 and the top surface 42 decreases from a maximum near the flat platform back wall 32 to a minimum at a distal end 44 of the linking arm 40.

Figure 5:
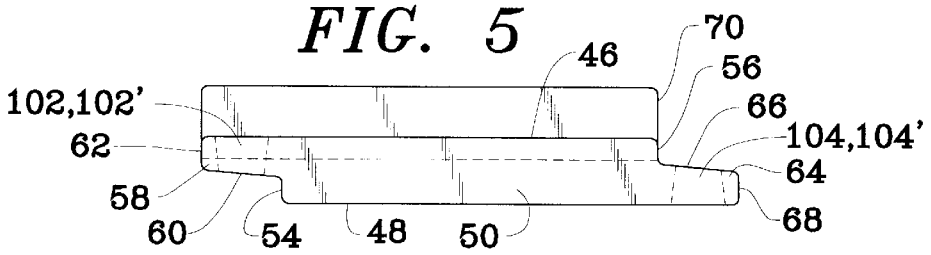
FIG. 5 is a side elevation view of an intermediate platform of the present invention.
Figure 6:
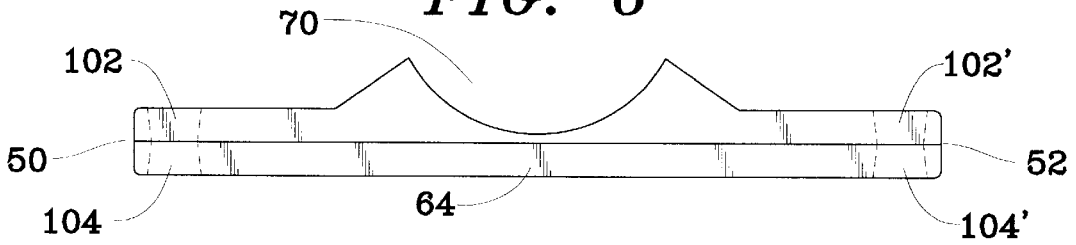
FIG. 6 is a back elevation view of an intermediate platform of the present invention.

Now referring generally to FIGS. 2, 5, and 6, the cradling platform 14 is a substantially-rectangular, rigid structure having a horizontal upper surface 46 spaced apart from a horizontal lower surface 48 by a first vertical sidewall 50, a second vertical sidewall 52, a vertical front wall 54, and a vertical back wall 56. An integral frontal linking arm 58 extends from the front wall 54. The frontal linking arm 58 is bounded by the upper surface 46, first sidewall 50, and second sidewall 52 of the cradling platform 12. The frontal linking arm 58 has an inclined bottom surface 60. As such, the distance between the upper surface 46 and the bottom surface 60 decreases from a maximum near the cradling platform front wall 54 to a minimum at a distal end 62 of the linking arm 58. An integral rearward linking arm 64 extends from the back wall 56. The rearward linking arm 64 is bounded by the lower surface 48, first sidewall 50, and second sidewall 52 of the cradling platform 12. The rearward linking arm 64 has an inclined top surface 66. As such, the distance between the lower surface 48 and the top surface 66 decreases from a maximum near the cradling platform back wall 56 to a minimum at a distal end 68 of the linking arm 64. An arched support channel 70 rises upward from the cradling platform upper surface 46. The support channel 70 runs the longitudinal length of the upper surface 46. The support channel 70 resembles a half-pipe which opens upward. To ease loading and unloading of a watercraft, the channel 70 advantageously has a smooth surface to keep sliding friction between the channel 70 and the watercraft to a minimum.

Figure 7:
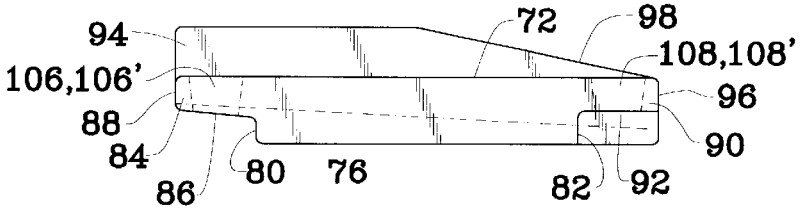
FIG. 7 is a side elevation view of a ramp platform of the present invention.
Figure 8:
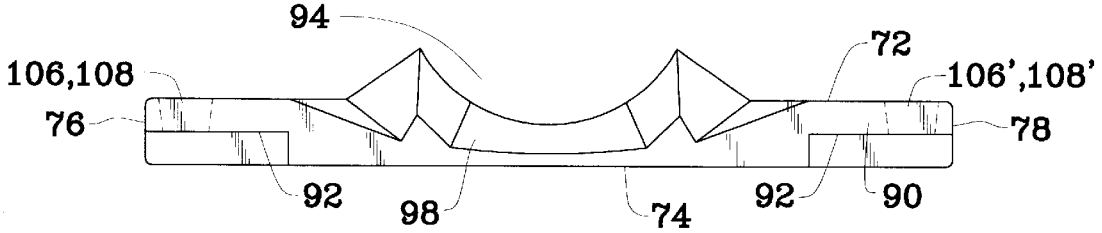
FIG. 8 is a back elevation view of a ramp platform of the present invention.

Now referring generally to FIGS. 2, 7, and 8, the ramp platform 16 is a substantially-rectangular, rigid structure having a horizontal upper surface 72 spaced apart from a horizontal lower surface 74 by a first vertical sidewall 76, a second vertical sidewall 78, a vertical front wall 80, and a vertical back wall 82. An integral frontal linking arm 84 extends from the front wall 80. The frontal linking arm 84 is bounded by the upper surface 72, first sidewall 76, and second sidewall 78 of the cradling platform 14. The frontal linking arm 84 has an inclined bottom surface 86. As such, the distance between the upper surface 72 and the bottom surface 86 decreases from a maximum near the ramp platform front wall 80 to a minimum at a distal end 88 of the linking arm 84. An integral rearward linking arm 90 extends from the back wall 82. The rearward linking arm 90 is bounded by the upper surface 72, first sidewall 76, and second sidewall 78 of the ramp platform 12. The rearward linking arm 90 has a horizontal bottom surface 92. An arched support channel 94 extends upward from the ramp platform upper surface 72. The support channel 94 resembles a half-pipe which opens upward. To ease loading and unloading of a watercraft, the channel 94 advantageously has a smooth surface to keep sliding friction between the channel 94 and the watercraft to a minimum. The support channel 94 runs the longitudinal length of the ramp platform upper surface 72. Near the ramp platform back wall, however, the support channel is tapered, passing through the rearward linking arm 90 to form a ramped entrance 98. The ramped entrance 98 resembles a three-sided funnel. The entrance 98 serves to guide a watercraft into the support channels 70,94. The entrance 98 also provides an incline along which a watercraft may travel during loading, as it leaves the water, or during unloading, as it enters the water. As a result, the ramped entrance 98 advantageously eliminates the need for a lifting crane to raise or lower the watercraft.

Referring to FIGS. 3 and 4, frusto-conical bores 20,20' extend vertically through flat platform frontal linking arm 34. Bore 20 passes through linking arm 34 near the first sidewall 26, while bore 20' passes through linking arm 34 near the second sidewall 28. The bores 20,20' are tapered: their diameters decrease from a maximum near the upper surface 22 to a minimum near the linking arm bottom surface 36. Frusto-conical bores 100,100' extend vertically through flat platform rearward linking arm 40. Bore 100 passes through linking arm 40 near the first sidewall 26, while bore 100' passes through linking arm 40 near the second sidewall 28. The bores 100,100' are tapered: their diameters decrease from a maximum near the lower surface 24 to a minimum near the linking arm top surface 42. Each bore 20,20',100,100' is characterized by a pair of vertical channels 110. The bores 20,20',100,100' and channels 110 are shaped to accept linking pins 112 and their associated locking tabs 114.

Referring to FIGS. 5 and 6, frusto-conical bores 102,102' extend vertically through cradling platform frontal linking arm 58. Bore 102 passes through linking arm 58 near the first sidewall 50, while bore 102' passes through linking arm 58 near the second sidewall 52. The bores 102,102' are tapered: their diameters decrease from a maximum near the upper surface 46 to a minimum near the linking arm bottom surface 60. Frusto-conical bores 104,104' extend vertically through cradling platform rearward linking arm 64. Bore 104 passes through linking arm 64 near the first sidewall 50, while bore 104' passes through linking arm 64 near the second sidewall 52. The bores 104,104' are tapered: their diameters decrease from a maximum near the lower surface 48 to a minimum near the linking arm top surface 66. Each bore 102,102',104,104' is characterized by a pair of vertical channels 110. The bores 102,102',104,104' and channels 110 are shaped to accept linking pins 112 and their associated locking tabs 114.

Referring to FIGS. 7 and 8, frusto-conical bores 106,106' extend vertically through ramp platform frontal linking arm 84. Bore 106 passes through linking arm 84 near the first sidewall 76, while bore 106' passes through linking arm 84 near the second sidewall 78. The bores 106,106' are tapered: their diameters decrease from a maximum near the upper surface 72 to a minimum near the linking arm bottom surface 86. Frusto-conical bores 108,108' extend vertically through ramp platform rearward linking arm 90. Bore 108 passes through linking arm 90 near the first sidewall 76, while bore 108' passes through linking arm 90 near the second sidewall 78. The bores 108,108' are tapered: their diameters decrease from a maximum near the upper surface 72 to a minimum near the arm bottom surface 92. Each bore 106,106',108,108' is characterized by a pair of vertical channels 110. The bores 106,106',108,108' and channels 110 are shaped to accept linking pins 112 and their associated locking tabs 114.

Figure 9:
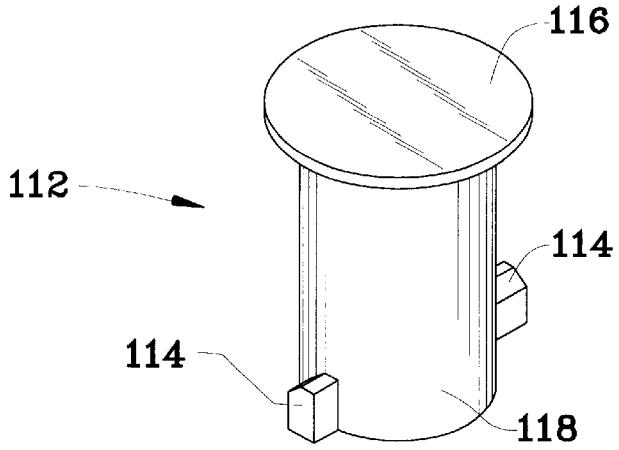
FIG. 9 is a perspective view of a linking pin of the present invention.

Referring generally to FIGS. 2 and 9, linking pins 112 are used to secure adjacent platforms 12,14,16 together. Each pin 112 has an enlarged head plate 116 and a cylindrical body 118. A pair of locking tabs 114 extends radially from the body 118, near the bottom of the pin 112. The tabs 114 are sized to fit bore channels 110. A example of pin 112 use is now provided. The back wall 32 of flat platform 12 is placed against front wall 54 of cradling platform 14, so that the flat plate rearward linking arm 40 overlaps cradling platform frontal linking arm 58, and bores 100,100' are aligned with bores 102,102'. A linking pin 112 is positioned over bore 102. The pin 112 is pushed down and fed through bore 102 into bore 100. When the locking tabs 114 emerge past the lower surface 24 of the flat platform frontal linking arm 40, the pin 112 is rotated until the tabs 114 are no longer aligned with the channels 110 of bore 100, thus securing the pin 112 within the bores 100,102. This procedure is repeated with aligned bores 102' and 100'. The ramp platform frontal linking arm 84 is attached to the cradling platform rearward linking arm 64 in a similar fashion. Additional platforms may be added by repeating this overlapping and linking pin 112 placement procedure with as many platforms 12,14,16 as are needed.

In one embodiment, the device is secured to a dock 18 via tethering posts 19 which pass through selected bores 20,20'. The posts 19 are part of a four-piece unit. The unit includes a pipe securing ring 120 which is bolted to a vertical face of the dock 18. A horizontal piece of pipe 122 extends away from the dock 18, outward from the ring 120. A ninety-degree transition elbow 124 is glued to the free end of the horizontal pipe 122. A vertical piece of pipe 19 extends from the elbow 124, downward into the water. The vertical pipe 19 extends into the water far enough so that the bottom edge of the pipe 19 is below the water surface at all times, even during possible low tides. The outer diameter of the vertical pipe 19 is chosen to allow unencumbered vertical motion of the device 10, in response to tides or wave action. In one embodiment, the vertical pipes 19 have an outer diameter of six inches, while the bores 20,20' have a minimum inner diameter of seven inches. Although the tethering posts 19 have been described as part of a four-piece unit, other configurations may be used. For example, a piling driven into an underwater surface may also be sufficient.

A watercraft is loaded onto the support device 10 by driving the watercraft towards the device 10 and aiming the bow of the watercraft towards the ramped entrance 98. As the watercraft enters the ramped entrance 98, the watercraft's bow will travel upward and enter the ramp platform support channel 94. As the watercraft travels along the ramped entrance 98, the ramp platform 16 will tend to tilt. That is, the back wall 82 will move down, and the front wall 80 will move up. This tilting is controlled by the linking pins 112 which are locked into place within bores 104,104',106,106'. Since the bores 104,104',106,106' are frusto-conical and the pins 112 are cylindrical, the ramp platform frontal linking arm 84 and the cradling platform rearward linking arm 64 are attached, essentially, in a hinge-like fashion. Additionally, the incline found on the bottom surface 86 of the ramp platform frontal linking arm 84 is opposite the incline found on the top surface 66 of the cradling platform rearward linking arm 64. These opposite inclines allow the ramp platform frontal linking arm 84 to pivot away from cradling platform rearward linking arm 64 without damage to either arm.

As more of the watercraft travels further onto the device 10, the cradling platform 14 begins to tilt with respect to the flat platform 12. This titling is facilitated by the cooperation of bores 100,100',102,102' and the linking pins 112 secured therein. As described above, the frusto-conical shape of the bores 100,100',102,102' combines with the cylindrical shape of the pins 112 to provide a hinge-like linkage between the flat platform 12 and the cradling platform 14. Additionally, the incline found on the bottom surface 60 of the cradling platform frontal linking arm 58 is opposite the incline found on the top surface 42 of the flat platform rearward linking arm 40. These opposite inclines allow the cradling platform frontal linking arm 58 to pivot away from flat platform rearward linking arm 40 without damage to either arm.

When the watercraft is completely loaded onto the device 10, the support channels 70,94 will keep the watercraft upright, allowing individuals to enter or leave the watercraft. The weight of the watercraft and individuals is supported by the device 10. The watercraft 10 may be unloaded by reversing the above-described procedure.

Figure 10:
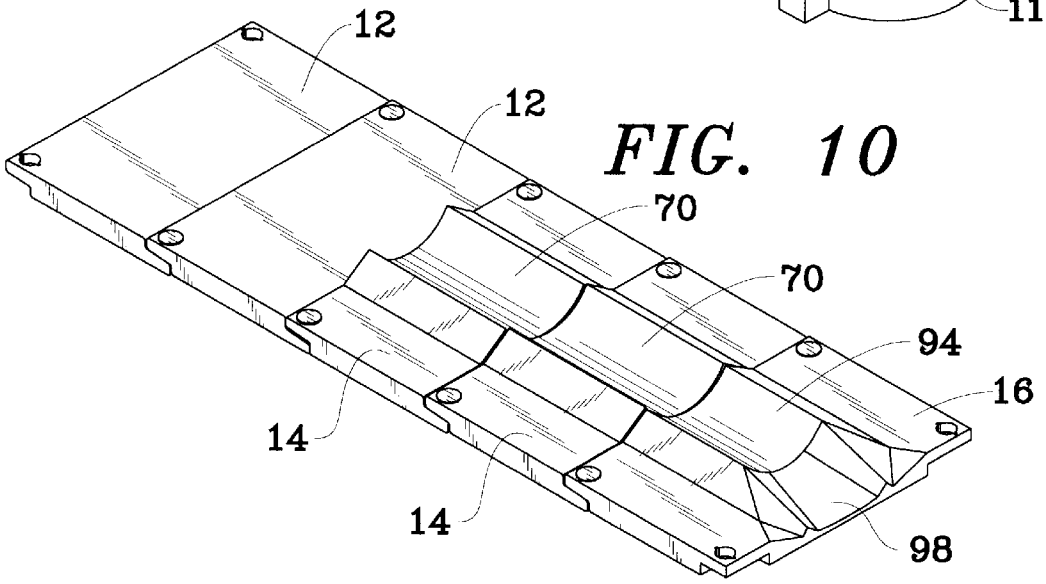
FIG. 10 is a perspective view of an expanded version of the present invention.
Figure 11:
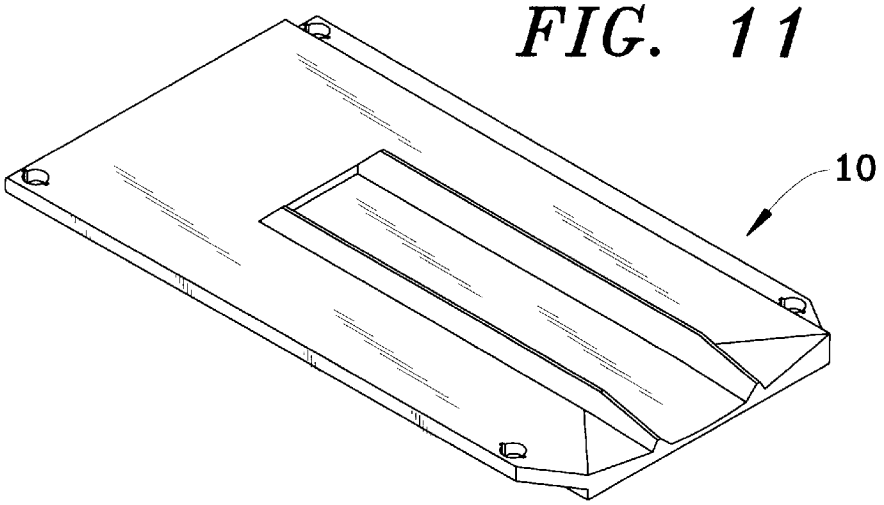
FIG. 11 is a perspective view of a single-piece embodiment of the present invention.

Although the device 10 has been described as containing one flat platform 12, one cradling platform 14, and one ramp platform 16, other configurations may be used. As shown in FIG. 10, several of each type of platform 12,14,16 may be used to accommodate an individual's docking needs or watercraft size. A one-piece embodiment, as shown in FIG. 11, is also possible.

In addition, although the device 10 has been shown with its longitudinal axis oriented perpendicular to the longitudinal axis of a dock 18, other orientations are possible. For example, the device 10 may be rotated ninety degrees so that the longitudinal axis of the device 10 is parallel to the longitudinal axis of the dock 18. In such a case, the distance between tethering posts 19 is increased and the posts 19 would pass through bores 20',108' of several platforms 12,16. The linking pins 112 and tethering posts are sized to fit within each of the platform bores 20,20',100,100',102, 102',104,104',106,106',108,108'.

Figure 12:
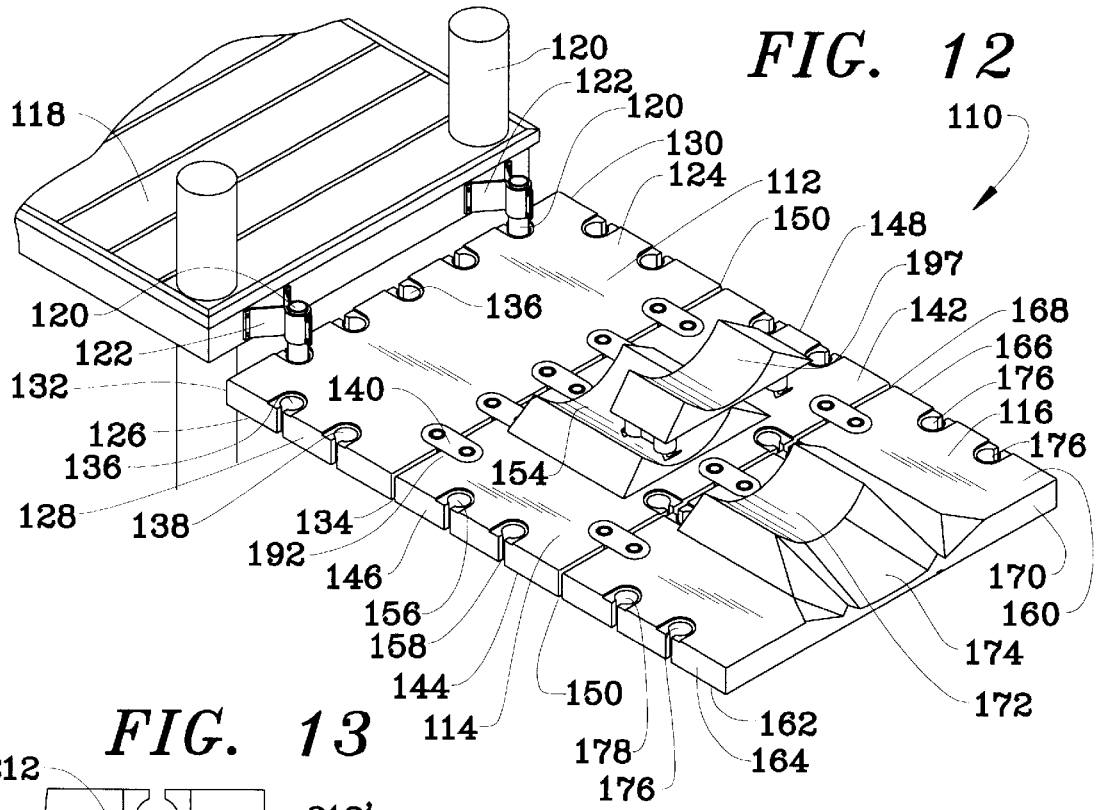
FIG. 12 is a perspective view of the support structure of the present invention.

With reference to FIG. 12, a pictorial view of another embodiment of the present dock assembly 110 is shown. By way of overview, the dock assembly 110 includes a flat platform 112, a cradling platform 114, and a ramp platform 116. The platforms 112,114, and 116 are linked together, providing a floating surface on which a watercraft may be parked. As will be described below, the dock assembly 110 is attached to a rigid dock structure 118 via tethering posts 120. The tethering posts 120 are secured to the rigid dock by attachment brackets 122 that maintain the tethering posts in a vertical orientation, thus allowing the dock assembly 110 to move in response to wave or tidal action.

With continued reference to FIG. 12, the flat platform 112 is a substantially-rectangular, rigid structure having a horizontal upper surface 124 spaced apart from a horizontal lower surface 126 by a first vertical sidewall 128, a second vertical sidewall 130, a vertical front wall 132, and a vertical back wall 134.

The perimeter of the flat platform 112 is punctuated by securing cavities 136 that extend orthogonally between the upper surface 124 and the lower surface 126. The securing cavities 136 are essentially-cylindrical, having a uniform cross section throughout. Each securing cavity 136 includes a passthrough slot 138 that, as described below, accommodates an insertion plug 140.

The cradling platform 114 is a substantially-rectangular, rigid structure having a horizontal upper surface 142 spaced apart from a horizontal lower surface 144 by a first vertical sidewall 146, a second vertical sidewall 148, a vertical front wall 150, and a vertical back wall 152. An arched support channel 154 rises upward from the cradling platform upper surface 142. The support channel 154 resembles a half-pipe which opens upward. To ease loading and unloading of a watercraft, the channel 154 advantageously has a smooth surface to keep sliding friction between the channel 154 and the watercraft to a minimum.

The perimeter of the cradling platform 114 is punctuated by securing cavities 156 that extend orthogonally between the upper surface 142 and the lower surface 144. The securing cavities 156 are essentially-cylindrical, having a uniform cross section throughout. Each securing cavity 156 includes a passthrough slot 158 that, as described below, accommodates an insertion plug 140.

The ramp platform 116 is a substantially-rectangular, rigid structure having a horizontal upper surface 160 spaced apart from a horizontal lower surface 162 by a first vertical sidewall 164, a second vertical sidewall 166, a vertical front wall 168, and a vertical back wall 170. An arched support channel 172 extends upward from the ramp platform upper surface 160. The support channel 172 resembles a half-pipe which opens upward. To ease loading and unloading of a watercraft, the channel 172 advantageously has a smooth surface to keep sliding friction between the channel 172 and the watercraft to a minimum. Near the ramp platform back wall 170, however, the support channel is tapered to form a ramped entrance 174. The ramped entrance 174 resembles a three-sided funnel. The entrance 174 serves to guide a watercraft into the support channels 154,172. The entrance 174 also provides an incline along which a watercraft may travel during loading, as it leaves the water, or during unloading, as it enters the water. As a result, the ramped entrance 174 advantageously eliminates the need for a lifting crane to raise or lower the watercraft.

The perimeter of the ramp platform 116 is punctuated by securing cavities 176 that extend orthogonally between the upper surface 142 and the lower surface 144. The securing cavities 176 are essentially-cylindrical, having a uniform cross section throughout. Each securing cavity 176 includes a passthrough slot 178 that, as described below, accommodates an insertion plug 140.

Figure 14:
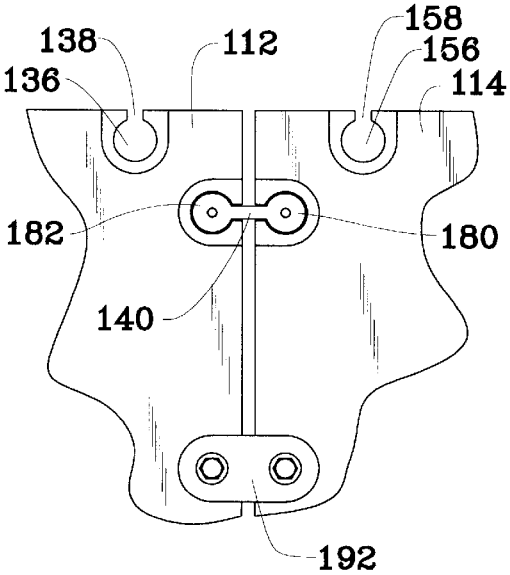
FIG. 14 is a partial top plan view of a two platforms joined by insertion plugs.
Figure 13A:
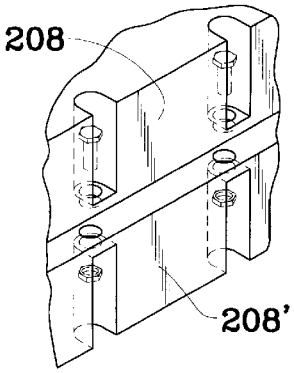
FIG. 13A is a partial perspective view of the post adaptor shown in FIG. 13.

As shown in FIG. 14, adjacent flat platform 112 and cradling platform 114 are linked together by insertion plugs 140. The insertion plugs 140 are shaped to engage aligned pairs of securing cavities 136, 156, 176. As such, the insertion plugs 140 include a contoured first end 180 spaced apart from a contoured second end 182 by a rectangular middle portion 184. In FIG. 14, the insertion plug first ends 180 occupy flat platform securing cavities 136; the insertion plug second ends 182 occupy cradling platform securing cavities 156. The passthrough slots 138,158, accommodate the insertion plug middle portion 184, allowing the insertion plug 140 to span between the securing cavities 136, 156. By using additional insertion plugs 140, any number of platforms 112,114,116 may be joined.

Figure 15:
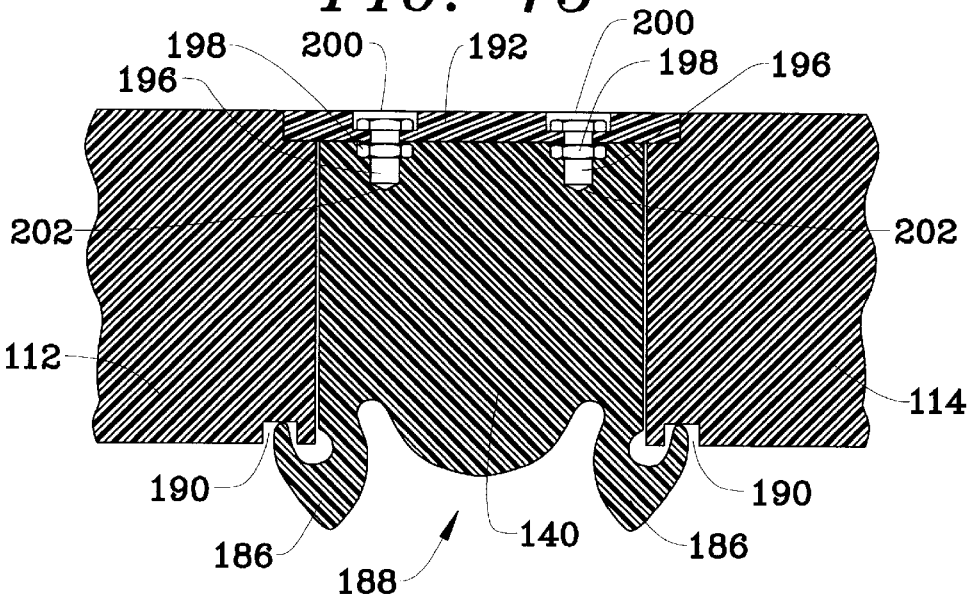
FIG. 15 is a cross-section view of an insertion plug and capping member engaging a pair of the present invention.
Figure 15A:
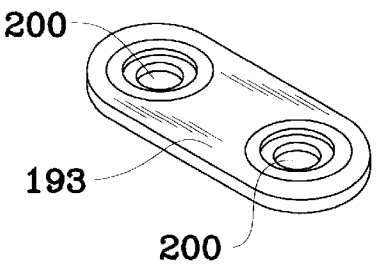
FIG. 15A is a perspective view of the flat plate capping member shown in FIG. 15.
Figure 15B:
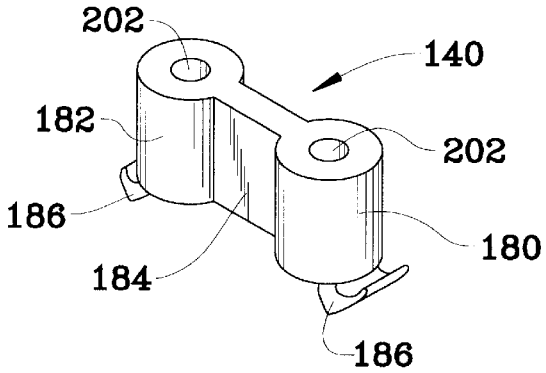
FIG. 15B is a perspective view of the insertion plug shown in FIG. 15.

With additional reference to FIGS. 15 and 15B, resiliently-deformable retention tabs 186 extend from the insertion plug lower surface 188 and engage positioning recesses 190 formed in the platform lower surfaces 126,144, 162. The retention tabs 186 are formed integral with bottom surface 188 of the insertion plug 140 and cooperate with the positioning recesses 190 to prevent upward motion of the insertion plugs 140. In use, as shown in FIG. 15B, the insertion plug ends 180,182 are fed downward, through the plane of the platform upper surfaces 124,142, and into the securing cavities 136,156, respectively. As the insertion plug ends 180,182 are introduced into the securing cavities 136, 156, the retention tabs 190 flex inward, away from an equilibrium position, toward the central axis of the insertion plug 140. As the insertion plug bottom surface 188 travels toward the plane of the platform lower surfaces 126,144, the insertion plug ends 180,182 substantially fill the securing cavities 136,156, respectively, and the insertion plug middle portion 184 translates downward within the passthrough slots 138,158. As the insertion plug bottom surface 188 and platform lower surfaces 126 become substantially co-planar, the retention tabs 186 extend out of the securing cavities 136,156 and return to an equilibrium position, thereby engaging corresponding positioning recesses 190.

Now with reference to FIG. 15, a capping member 192 prevents unwanted downward motion of the insertion plug 140. The capping member 192 is removably secured against the insertion plug top surface 194. In a preferred embodiment, attachment bolts 196 engage receiving nuts 198 that are disposed within the insertion plugs 140.

Each capping member 192 is perforated by first bolt apertures 200 that align vertically with second bolt apertures 202 located in the insertion plugs 140. After the insertion plug 140 is in place and the retention tabs 186 have engaged the corresponding positioning recesses 190, the capping member is placed against the insertion plug top surface 194, aligning the first bolt apertures 200 with the second bolt apertures 202. Once the bolt apertures 200,202 are aligned, the attachment bolts 196 are threaded into the receiving nuts 198 and tightened in place. In this manner, each insertion plug 140 is locked within a pair of cooperating securing cavities 136,156, with the retention tabs 186 preventing upward plug 140 motion and the capping member 192 preventing downward plug 140 motion. The remaining pairs of adjacent securing cavities 136, 156, and 176 are joined in similar fashion. The orientation of the insertion plug ends 180,182, with respect to the securing cavities 136,156,176 is not crucial: the insertion plug ends are congruent, and the securing cavities are also of uniform size. As a result, each insertion plug end 180,182 will fit into securing cavities 136,156,176 on any of the various platforms 112,114,116.

Figure 16:
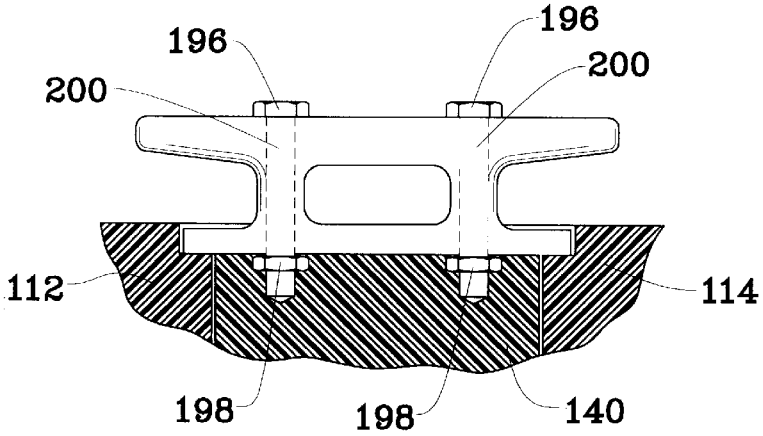
FIG. 16 is a partial cross section view of a cleat-style capping member.

With reference to FIGS. 12, 15A, and 16, three different types of capping member 192 are employed by this dock assembly 110. For example, the capping member 192 may be a flat plate 193, as shown in FIG. 15A, or a cleat construction 195, as shown in FIG. 16. The capping member 192 may also be a cradling plug 197, shaped to match the contours of the support channels 154,172. The cradling plug 193 is inserted, as shown in FIG. 12, along the seam between abutting cradling platforms 114 and ramp platforms 116. Each version of the capping member 192 includes first bolt apertures 200.

Additionally, as shown in FIG. 12, the platform upper surfaces 124,142,160 include positioning notches 204 that accommodate the capping members 192. The flat plate embodiment of the capping member 192 fits entirely within the positioning notch 204.

Figure 17A:
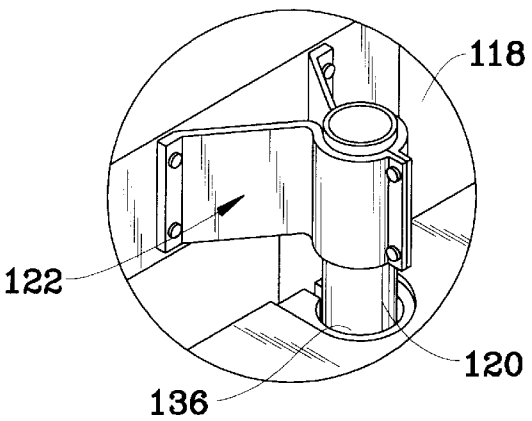
FIG. 17A is a close-up view of the attachment brackets of the present device.
Figure 17:
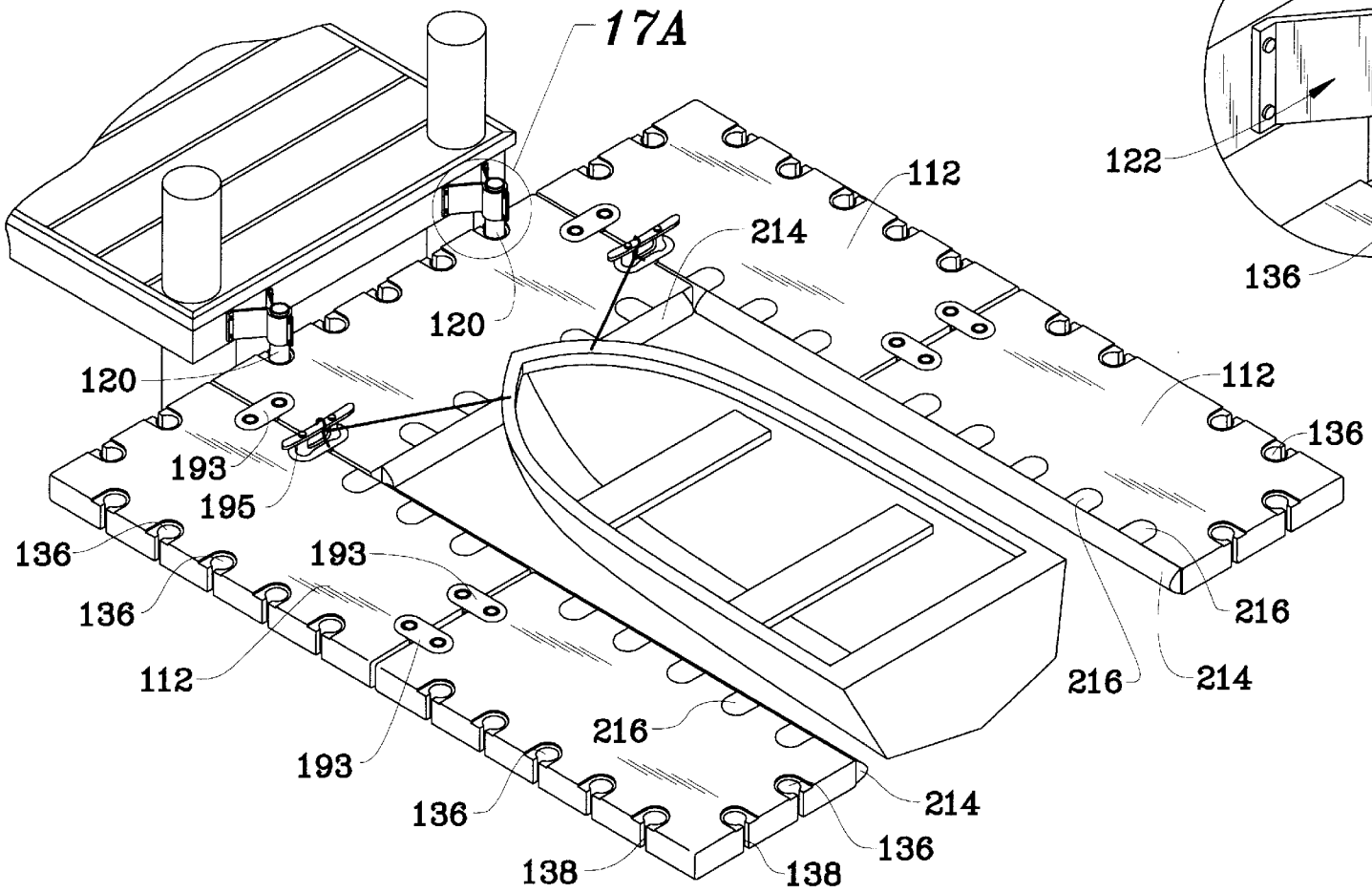
FIG. 17 is a perspective view of an alternate embodiment of the present invention.

As shown in FIGS. 12 and 17, the dock assembly 110 is secured to a dock 118 via tethering posts 120. The tethering posts 120 are attached to the dock 118 by attachment brackets 122. As shown in FIG. 17A, each attachment bracket 122 is a two-piece unit shaped to encircle one of the tethering posts 120. Both pieces of the bracket 122 are bolted together, and cooperate to hold a tethering post 120 in a vertically-aligned orientation.

Figure 13:
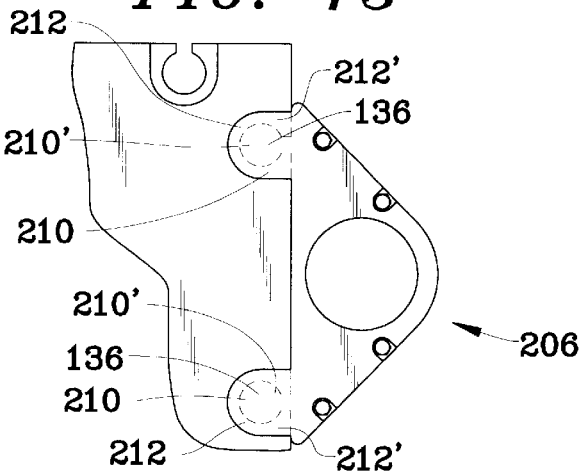
FIG. 13 is a partial top plan view of the post adaptor of the present invention.

In one embodiment, the outer diameter of the tethering posts 120 allows the tethering post to fit within the platform securing cavities 136,156,176. However, in an effort to accommodate tethering posts 120 of different sizes, post adaptors 206 are provided, as shown in FIG. 13. Post adaptors 206 are used when the available tethering posts 120 will not fit within the securing cavities 136,156,176. With additional reference to FIG. 2A, each post adaptor 206 includes a top connector plank 208 and a bottom connector plank 208'. The top connector plank 208 includes a pair of attachment fingers 210, each shaped to engage a selected securing cavity 136,156,176. The bottom plank 208' is a mirror image of the top connector plank 208 and includes a pair of attachment fingers 210'.

In one embodiment, the post adaptors 206 are secured to a platform 112,114,116 by inserting attachment fingers 210, 210' into dock-facing securing cavities 136,156,176. Once the attachment fingers 210,210' are in place, the top connector plank 208 and connector plank 208' are bolted together in a sandwich-style arrangement. The attachment fingers 210,210' each include a stop flange 212,212' that prevents unwanted vertical motion of the attachment fingers and locks the post adaptor 206 in place. When the connector planks 208,208' are bolted together, the top connector plank stop flanges 212 fit into positioning notches 204, and the bottom connector plank stop flanges 212' abut platform lower surfaces 126,144,162. Each connector plank 208,208' includes a post bore 214,214' that accommodates a tethering post 120.

Figure 18:
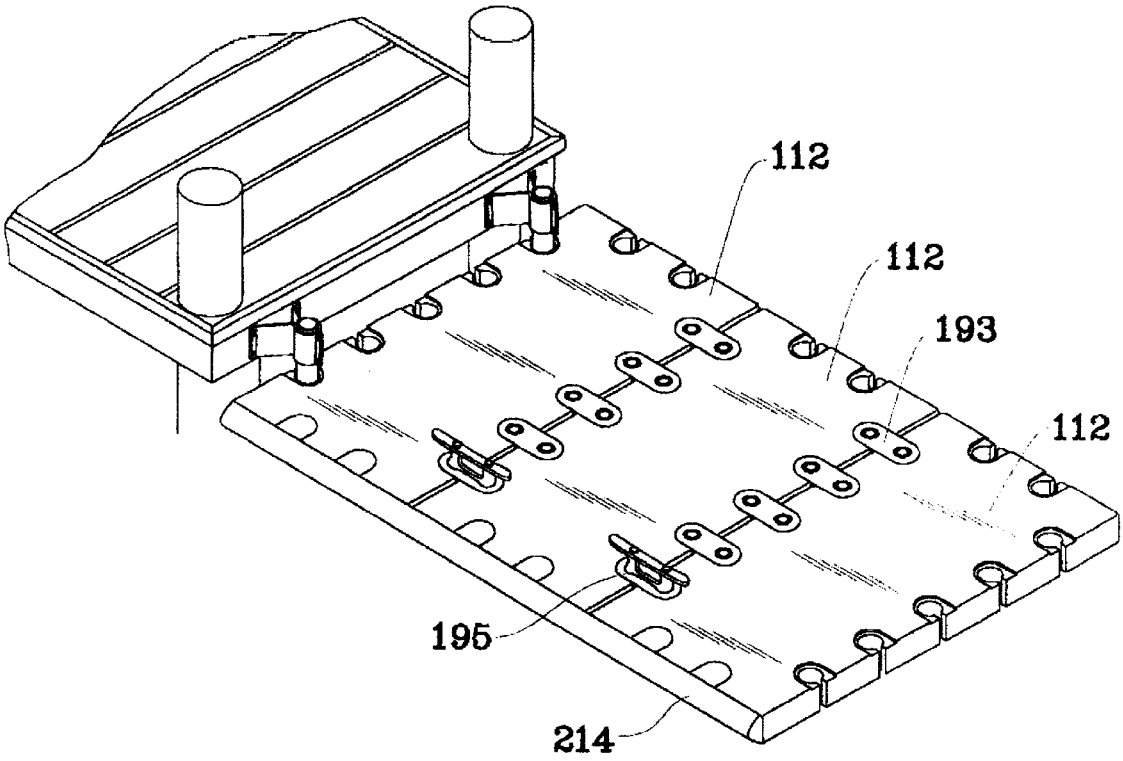
FIG. 18 is a perspective view of an alternate embodiment of the present invention.

Although the present embodiment of the dock assembly 110 includes a flat platform 112, a cradling platform, 114, and a ramp platform 116, other configurations are possible. As shown in FIGS. 17 and 18, the dock assembly 110 may be assembled without a cradling platform 114 or ramp platform 116. By connecting several flat platforms 112 together, the dock assembly 110 is especially useful as a floating dock to which watercraft may be moored. In this embodiment, resiliently compressible bumpers 214 are attached to boat-facing portions of the platforms 112. The bumpers 214 include connector projections 216 that positively engage platform securing cavities 136. Once attached to the perimeter of the dock assembly 110, the bumpers 214 act as a cushion that allows a watercraft to contact the platforms 112 without damage.

Figure 19:
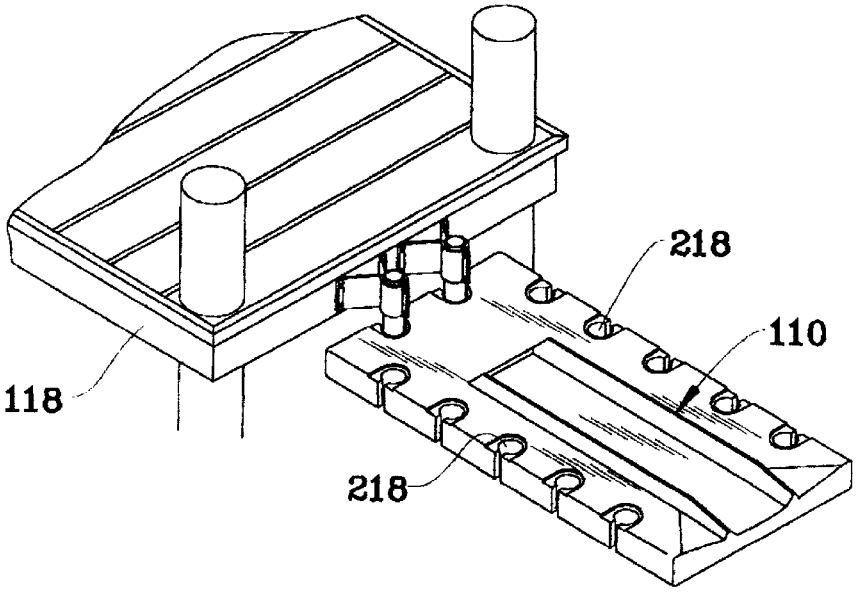
FIG. 19 is a perspective view of a single-piece embodiment of the present invention.

As shown in FIG. 19, the dock assembly 110 may also be formed as a single-piece embodiment. The single piece embodiment includes securing cavities 218 that are compatible with the insertion plugs 140 described above. As a result, the single piece embodiment may be used in conjunction with other platforms 112,114,116, if desired. The single piece embodiment may be aligned as needed with respect to an existing fixed dock 118.

The watercraft support is manufactured by use of a clamshell mold having an internal cavity in the shape of one of the platforms. A predetermined mixture of polyethylene and an emulsifier is injected into the clamshell mold and the mold is then heated to a first temperature for about an hour. During the heating process, the clamshell is rotated while heating the mold causing the mixture to coat the internal cavity. The clamshell mold is then heated to a second predetermined raised temperature for a second predetermined period of time, causing the emulsifier to produce gas bubbles. Rotating of the clamshell mold continues until the mixture is allowed to cool.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A watercraft support device, said device comprising:

at least one cradling platform, said cradling platform being a substantially-rectangular rigid structure having an upper surface spaced apart from a lower surface by a first sidewall, a second sidewall, a front wall, and a back wall;

at least one ramp platform, said ramp platform being a substantially-rectangular rigid structure having an upper surface spaced apart from a lower surface by a first sidewall, a second sidewall, a front wall, and a back wall;

linking means for interlocking said platforms together, said linking means including at least one ramp platform securing cavity spanning between said ramp platform upper surface and said ramp platform lower surface, said ramp platform securing cavity characterized by a uniform cross section;

at least one cradling platform securing cavity spanning between said cradling platform upper surface and said cradling platform lower surface, said cradling platform securing cavity characterized by a uniform cross section; and at least one insertion plug having a contoured first end spaced apart from a contoured second end by a middle portion, each of said contoured ends sized to selectively engage one of said securing cavities; and attachment means for securing said support device to a dock, whereby said insertion plug is sized so that each of said ends will simultaneously engage a corresponding one of said securing cavities.

2. The watercraft support device of claim 1, wherein:

said insertion plug includes at least one resiliently-deflectable retention tab extending from a bottom surface of said insertion plug, said retention tab shaped to selectively engage said platform bottom surfaces.

3. The watercraft support device of claim 2, wherein:

each of said platform bottom surfaces further includes at least one orientation groove sized and positioned to provide a preferred location for said retention tabs.

4. The watercraft support device of claim 2, further including:

at least one capping member adapted and positioned to simultaneously engage an upper surface of said insertion plug and said platform upper surfaces, whereby said capping member and said retention tabs cooperate to prevent unwanted motion of said insertion plug within said securing cavities.

5. The watercraft support device of claim 4, including:

at least one receiving nut disposed within said insertion plug; and at least one attachment bolt, said attachment bolt passing through a first bolt aperture in said capping member and a second bolt aperture in said insertion plug to engage said receiving nut.

6. The watercraft support device of claim 4, wherein said capping member is a substantially-flat panel.

7. The watercraft support device of claim 4, wherein said capping member is a cleat extending upward from said platform upper surface.

8. The watercraft support device of claim 4, wherein each of said platform upper surfaces includes at least one positioning notch sized to accommodate said capping member.

9. The watercraft support device of claim 4, wherein said insertion plug first end has a uniform cross section, and said insertion plug second end has a uniform cross section.

10. The watercraft support device of claim 5, wherein said attachment means includes at least one tethering post positioned adjacent to said dock, said post extending through one of said securing cavities.

11. The watercraft support device of claim 5, wherein said attachment means includes:

at least one connecting plank extending from one of said platforms, said attachment plank having at least one post bore extending therethrough; and at least one tethering post positioned adjacent to said dock, said post extending through said post bore.

12. A watercraft support device, said device comprising:

a plurality of flat platforms, each of said flat platforms being a substantially-rectangular rigid structure having an upper surface spaced apart from a lower surface by a first sidewall, a second sidewall, a front wall, and a back wall;

linking means for interlocking said platforms together, said linking means including a plurality of securing cavities spanning between said platform upper surface and said platform lower surface, said platform securing cavity characterized by a uniform cross section;

at least one insertion plug having a contoured first end spaced apart from a contoured second end by a middle portion, each of said contoured ends sized to selectively engage one of said securing cavities; and attachment means for securing said support device to a dock, whereby said insertion plug is sized so that each of said ends will simultaneously engage a corresponding one of said securing cavities.

13. The watercraft support device of claim 12, wherein:

said insertion plug includes at least one resiliently-deflectable retention tab extending from a bottom surface of said insertion plug, said retention tab shaped to selectively engage said platform bottom surfaces.

14. The watercraft support device of claim 13, wherein:

each of said platform bottom surfaces further includes at least one orientation groove sized and positioned to provide a preferred location for said retention tabs.

15. The watercraft support device of claim 13, further including:

at least one capping member adapted and positioned to simultaneously engage an upper surface of said insertion plug and said platform upper surfaces, whereby said capping member and said retention tabs cooperate to prevent unwanted motion of said insertion plug within said securing cavities.

16. The watercraft support device of claim 15, including:

at least one receiving nut disposed within said insertion plug; and at least on attachment bolt, said attachment bolt passing through a first bolt aperture in said capping member and a second bolt aperture in said insertion plug to engage said receiving nut.

17. The watercraft support device of claim 15, wherein said capping member is a substantially-flat panel.

18. The watercraft support device of claim 15, wherein said capping member is a cleat extending upward from said platform upper surface.

19. The watercraft support device of claim 15, wherein:

each of said platform upper surfaces includes at least one positioning notch sized to accommodate said capping member.

20. The watercraft support device of claim 15, wherein said insertion plug first end has a uniform cross section, and said insertion plug second end has a uniform cross section.

21. The watercraft support device of claim 16, wherein said attachment means includes at least one tethering post positioned adjacent to said dock, said post extending through one of said securing cavities.

22. The watercraft support device of claim 16, wherein said attachment means includes:

at least one connecting plank extending from one of said platforms, said attachment plank having at least one post bore extending therethrough; and at least one tethering post positioned adjacent to said dock, said post extending through said post bore.

* * * * *